US009747859B2

(12) United States Patent
Nam et al.

(10) Patent No.: US 9,747,859 B2
(45) Date of Patent: Aug. 29, 2017

(54) LIQUID CRYSTAL DISPLAY USING A GATE SHARING STRUCTURE

(71) Applicant: LG DISPLAY CO., LTD., Seoul (KR)

(72) Inventors: You-Sung Nam, Gwangmyeong-si (KR); Moon-Soo Chung, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 13/922,596

(22) Filed: Jun. 20, 2013

(65) Prior Publication Data

US 2014/0009458 A1 Jan. 9, 2014

(30) Foreign Application Priority Data

Jul. 5, 2012 (KR) ..... 10-2012-0073534

(51) Int. Cl.
*G09G 3/36* (2006.01)
*G09G 3/20* (2006.01)

(52) U.S. Cl.
CPC ..... *G09G 3/3696* (2013.01); *G09G 3/2022* (2013.01); *G09G 3/36* (2013.01); *G09G 3/3607* (2013.01); *G09G 3/3614* (2013.01)

(58) Field of Classification Search
CPC ..... G09G 3/3607; G09G 3/3266; G09G 3/3648–3/3666; G09G 3/3674–3/3681; G09G 2310/02–2310/0205; G09G 2310/021–2310/0216;
(Continued)

(56) References Cited

U.S. PATENT DOCUMENTS

2002/0154085 A1* 10/2002 Kim ..... G09G 3/3648 345/96
2006/0061534 A1* 3/2006 Lee ..... 345/92
2007/0182685 A1* 8/2007 Park et al. ..... 345/96
(Continued)

FOREIGN PATENT DOCUMENTS

CN 101308271 A 11/2008
CN 101424850 A 5/2009
(Continued)

OTHER PUBLICATIONS

Office Action issued in corresponding Korean Patent Application No. 10-2012-0073534, mailed Sep. 27, 2013, 4 pages.
(Continued)

*Primary Examiner* — Sanghyuk Park
(74) *Attorney, Agent, or Firm* — Brinks Gilson & Lione

(57) ABSTRACT

A liquid crystal display (LCD) device are disclosed, which reduce power consumption and improve an image quality. The LCD device includes a liquid crystal panel in which a plurality of sub-pixels is defined by intersection of a plurality of gate lines and a plurality of data lines, and sub-pixels adjacent to each other in a column direction are connected by sharing the plurality of gate lines. A gate driver may sequentially transfer a scan pulse to even-numbered gate lines and then sequentially transferring a scan pulse to odd-numbered gate lines. A data driver may be synchronized with the applied scan pulse in providing data voltage to columns of sub-pixels. The data driver provides the data voltage having different polarities to a neighbor data line during one frame interval such that sub-pixels are driven by a horizontal 2-dot inversion scheme.

17 Claims, 7 Drawing Sheets

(58) Field of Classification Search
CPC ..... G09G 2310/0262–2310/0267; G09G 2310/0278–2310/0283
See application file for complete search history.

(56) References Cited

U.S. PATENT DOCUMENTS

| | | | | |
|---|---|---|---|---|
| 2009/0322660 | A1* | 12/2009 | Chung et al. | 345/87 |
| 2010/0097366 | A1* | 4/2010 | Kitayama et al. | 345/213 |
| 2011/0012887 | A1* | 1/2011 | Lee et al. | 345/212 |
| 2011/0299023 | A1* | 12/2011 | Lee | 349/143 |
| 2012/0026206 | A1* | 2/2012 | Moon et al. | 345/690 |
| 2012/0120035 | A1* | 5/2012 | Yang | G09G 3/3614 345/205 |

FOREIGN PATENT DOCUMENTS

| | | | |
|---|---|---|---|
| CN | 101669162 | A | 3/2010 |
| JP | 2009098311 | A | 5/2009 |
| KR | 1020050097032 | A | 10/2005 |

OTHER PUBLICATIONS

Office Action issued in corresponding Korean Patent Application No. 10-2012-0073534, mailed Mar. 13, 2014, 4 pages.
Office Action dated Jul. 21, 2015 for corresponding Chinese Patent Application No. 201310279320.0, 12 pages.

* cited by examiner

FIRST SUBFRAME

SECOND SUBFRAME

LIQUID CRYSTAL DISPLAY USING A GATE SHARING STRUCTURE

This application claims the benefit of priority of Korean Patent Application No. 10-2012-0073534, filed on Jul. 5, 2012, which is hereby incorporated by reference as if fully set forth herein.

FIELD OF THE INVENTION

The present disclosure relates to a liquid crystal display (LCD) device for reducing power consumption simultaneously while improving an image quality.

DISCUSSION OF THE RELATED ART

A liquid crystal display (LCD) device adjusts light transmittance of a liquid crystal having dielectric anisotropy using an electric field, so that it can display images thereon.

Generally, the liquid crystal display (LCD) device includes a liquid crystal panel in which a plurality of pixels is arranged in the form of a matrix, a drive circuit for driving the liquid crystal panel, and a backlight unit for irradiating light to the liquid crystal panel.

As LCD product groups have increased in number and have rapidly come into widespread use, many developers and companies are conducting intensive research into improved LCDs having excellent characteristics, such as a large screen, thin thickness, high image quality, low power consumption, etc.

SUMMARY OF THE INVENTION

Accordingly, embodiments of the present invention are directed to a liquid crystal display (LCD) device and a method for driving the same that obviate one or more problems due to limitations and disadvantages of the related art.

An object of the present invention is to provide a liquid crystal display (LCD) device for reducing power consumption simultaneously while improving an image quality, and a method for driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by any combination of the structures described in the written description and claims hereof as well as the appended drawings.

In one aspect, a liquid crystal display (LCD) device includes: a liquid crystal panel in which a plurality of sub-pixels is defined by intersection of a plurality of gate lines and a plurality of data lines, and sub-pixels adjacent to each other in a column direction are connected by sharing the plurality of gate lines; a gate driver for sequentially driving even-numbered gate lines during a first subframe interval, and sequentially driving odd-numbered gate lines during a second subframe interval; a data driver for providing a data voltage for odd-column sub-pixels to the plurality of data lines during the first subframe interval, and providing the data voltage for even-column sub-pixels to the plurality of data lines during the second subframe interval; and a timing controller which arranges RGB data received from an external part in response to driving of the liquid crystal panel, provides the arranged RGB data to the data driver, generates a gate control signal and a data control signal, and thus controls the gate driver and the data driver, wherein the data driver provides the data voltage having different polarities to a neighbor data line during one frame interval in such a manner that the plurality of sub-pixels is driven by a horizontal 2-dot inversion scheme.

The gate driver may sequentially provide scan pulses to the even-numbered gate lines during a first subframe interval, and then sequentially provide the scan pulses to the odd-numbered gate lines during a second subframe interval.

The data driver may provide a data voltage for the odd-column sub-pixels to the plurality of data lines during the first subframe interval, and then provide a data voltage for the even-column sub-pixels to the plurality of data lines during the second subframe interval.

The odd-column sub-pixels may be connected by sharing the even-numbered gate lines, and the even-column sub-pixels may be connected by sharing the odd-numbered gate lines.

A connection structure may configure sub-pixels of a (4k−3)-th column (where k is a natural number) through sequential repetition of sub-pixels connected to even-numbered data lines and sub-pixels connected to odd-numbered data lines, sub-pixels of a (4k−1)-th column from among the odd-column sub-pixels may be achieved by sequential repetition of sub-pixels connected to odd-numbered data lines and sub-pixels connected to even-numbered data lines, sub-pixels of a (4k−2)-th column from among the even-column sub-pixels may be achieved by sequential repetition of sub-pixels connected to odd-numbered data lines and sub-pixels connected to even-numbered data lines, and sub-pixels of a 4k-th column from among the even-column sub-pixels may be achieved by sequential repetition of sub-pixels connected to even-numbered data lines and sub-pixels connected to odd-numbered data lines.

In another aspect, a method for driving a liquid crystal display (LCD) device in which a plurality of sub-pixels is defined by intersection of a plurality of gate lines and a plurality of data lines, and sub-pixels adjacent to each other in a column direction are connected by sharing the plurality of gate lines includes: sequentially driving even-numbered gate lines during a first subframe interval; sequentially driving odd-numbered gate lines during a second subframe interval; providing a data voltage for odd-column sub-pixels to the plurality of data lines during the first subframe interval; and providing the data voltage for even-column sub-pixels to the plurality of data lines during the second subframe interval, wherein the providing the data voltage to the plurality of data lines provides the data voltage having different polarities to a neighbor data line during one frame interval in such a manner that the plurality of sub-pixels is driven by a horizontal 2-dot inversion scheme.

The driving the gate lines may include: sequentially providing scan pulses to the even-numbered gate lines during a first subframe interval; and sequentially providing the scan pulses to the odd-numbered gate lines during a second subframe interval.

The providing the data voltage may include: providing a data voltage for the odd-column sub-pixels to the plurality of data lines during the first subframe interval; and providing a data voltage for the even-column sub-pixels to the plurality of data lines during the second subframe interval.

The odd-column sub-pixels may be connected by sharing the even-numbered gate lines; and the even-column sub-pixels may be connected by sharing the odd-numbered gate lines.

Sub-pixels of a (4k−3)-th column (where k is a natural number) from among the odd-column sub-pixels may be achieved by sequential repetition of sub-pixels connected to even-numbered data lines and sub-pixels connected to odd-numbered data lines, sub-pixels of a (4k−1)-th column from among the odd-column sub-pixels may be achieved by sequential repetition of sub-pixels connected to odd-numbered data lines and sub-pixels connected to even-numbered data lines, sub-pixels of a (4k−2)-th column from among the even-column sub-pixels may be achieved by sequential repetition of sub-pixels connected to odd-numbered data lines and sub-pixels connected to even-numbered data lines, and sub-pixels of a 4k-th column from among the even-column sub-pixels may be achieved by sequential repetition of sub-pixels connected to even-numbered data lines and sub-pixels connected to odd-numbered data lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Figure 1:
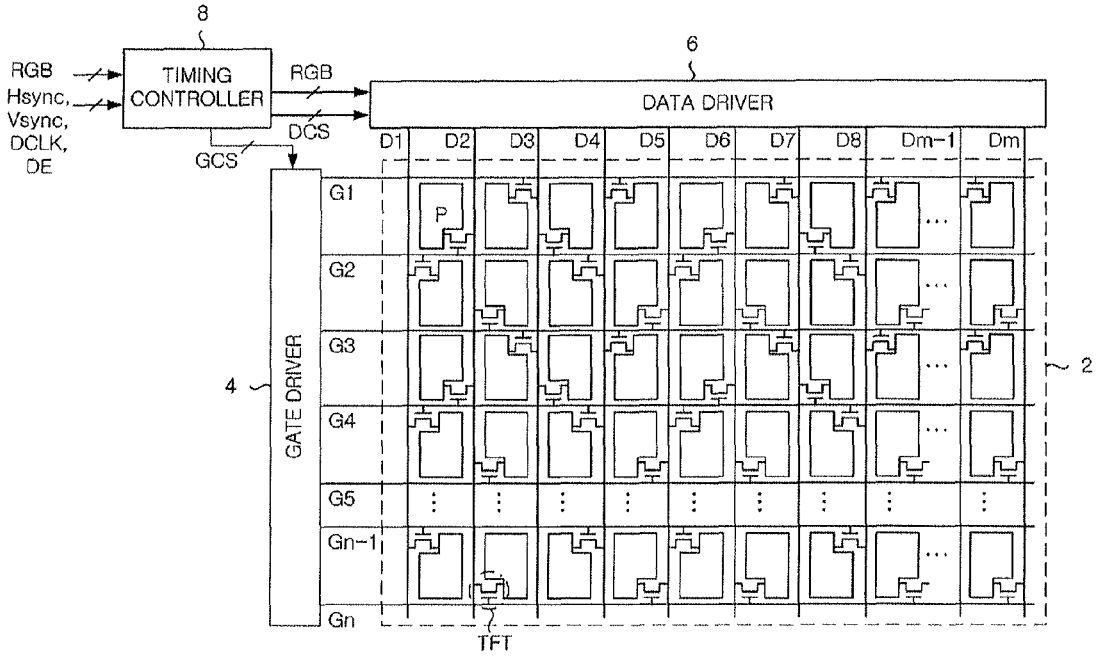
FIG. 1 is a schematic diagram illustrating a liquid crystal display (LCD) device according to an embodiment of the present invention.

FIG. 1 is a schematic diagram illustrating a liquid crystal display (LCD) device according to an embodiment of the present invention.

The LCD device shown in FIG. 1 includes a liquid crystal panel 2 in which multiple sub-pixels (P) are defined by the intersection of a plurality of gate lines (G1 to Gn) and a plurality of data lines (D1 to Dm). Sub-pixels (P) adjacent to each other in a column direction are connected by sharing the plurality of gate lines (G1 to Gn). The LCD device in FIG. 1 also includes a gate driver 4. The gate driver 4 may sequentially transfer a scan pulse to even-numbered gate lines (G2, G4, G6 . . . ) and then sequentially transfer a scan pulse to odd-numbered gate lines (G1, G3, G5 . . . ). A data driver 6 may be synchronized with the scan pulse applied to the even-numbered gate lines (G2, G4, G6 . . . ) in a manner to apply a data voltage for odd-column sub-pixels (P) to the data lines (D1 to Dm), and is then synchronized with the scan pulse applied to the odd-numbered gate lines (G1, G3, G5 . . . ) in a manner to apply a data voltage for even-column sub-pixels (P) to the data lines (D1 to Dm). A timing controller 8 may arrange image data (such as RGB data) received from an external part in response to driving of the liquid crystal panel 2, transfer the arranged image data to the data driver 6, and generate a gate control signal (GCS) and a data control signal (DCS) so as to control the gate driver 4 and the data driver 6.

This embodiment of the present invention may reduce power consumption of the gate driver 4 and the data driver 6. The reduction in power consumption may occur in two ways.

First, the LCD device may use an interlace driving scheme that includes dividing a frame into multiple subframes. The gate driver 4 may send a sequential scan pulse to a particular group of gate lines during a first subframe and to another group of gate lines during a second subframe. Thus, gate driver 4 may deactivate, power down, or otherwise limit power consumption for gate driving logic corresponding to gate lines that are inactive during a particular subframe, e.g., for which a scan pulse is not sent during the particular subframe. In this way, the LCD device may conserve power consumption.

Second, The LCD device may display pixels according to a dot inversion scheme even when the data driver 6 applies polarities to data lines according to a column inversion scheme. In this way, the LCD device may implement a dot inversion display without the data driver 6 having to alternate polarities sent through a particular data line (e.g., for each particular data voltage sent to a particular sub-pixel (P) connected to the data line). In other words, adjacent sub-pixels in a column of sub-pixels (P) may have different polarities even though the data driver 6 applies a single polarity to a particular data line, e.g., during a first frame or subframe.

In one example of a column inversion scheme, the data driver 6 may applies a first polarity pattern to a particular data line during a first frame and applies a second polarity pattern (e.g., opposite polarity) to the particular data line during a second frame.

Column inversion of the data driver 6 can be converted into horizontal 2-dot inversion, resulting in reduction of flicker and crosstalk. In addition, an unnecessary margin can be minimized in a thin film transistor (TFT) region of sub-pixels using a gate sharing structure, resulting in an increase in aperture ratio. For example and as described herein, adjacent pixels in a column of sub-pixels (P) may connect to the same gate line, allowing a reduction in the TFT region of the adjacent pixels.

Figure 2:
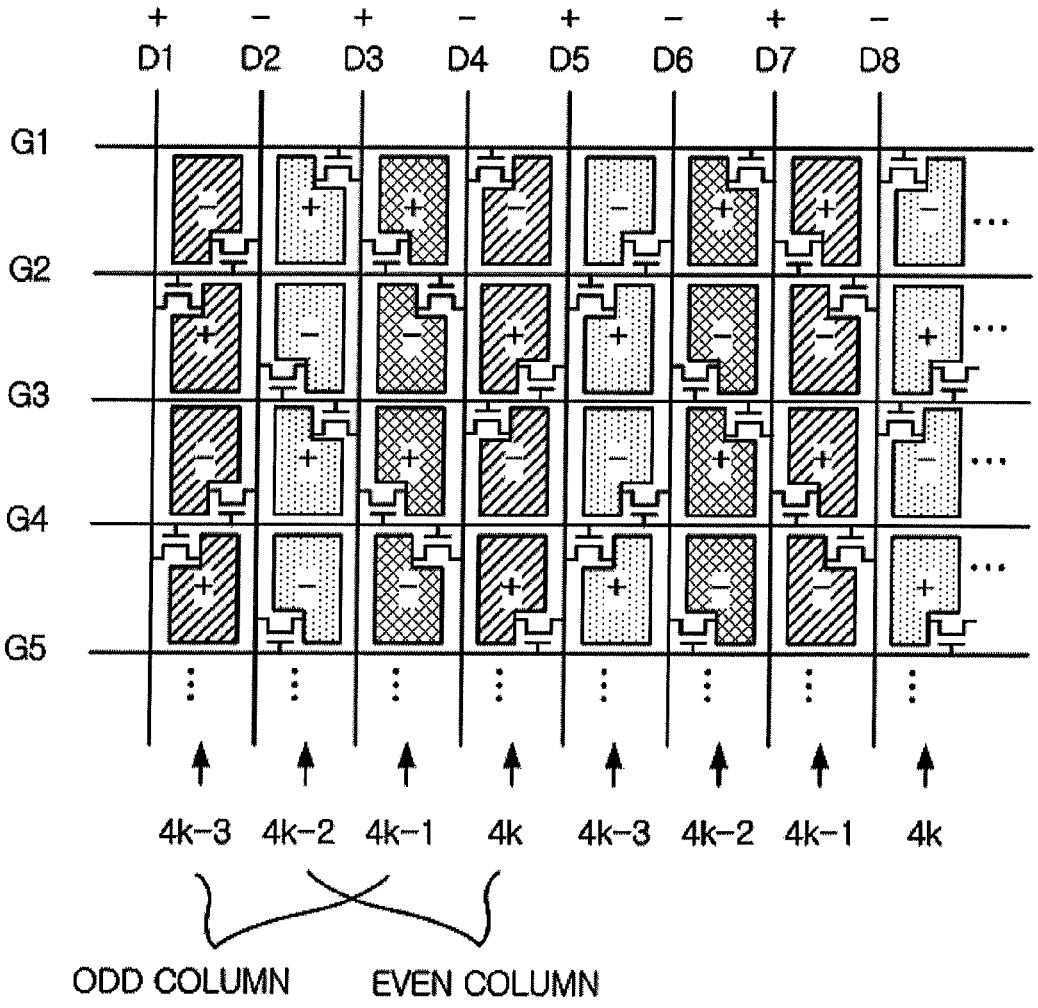
FIG. 2 is a schematic diagram illustrating a liquid crystal panel shown in FIG. 1.

FIG. 2 is a schematic diagram illustrating a liquid crystal panel 2 shown in FIG. 1. Referring to FIG. 2, a connection structure of the sub-pixels (P) and the gate lines (G1 to Gn) is implemented by which neighboring or adjacent sub-pixels (P) share one or more of the gate lines (G1 to Gn). For example and as shown in FIG. 2, odd-numbered sub-pixels (P) in a pair of consecutive rows of sub-pixels share even-numbered gate lines (G2, G4, G6 . . . ), and even-numbered sub-pixels (P) in a pair of consecutive rows of sub-pixels (P) share odd-numbered gate lines (G1, G3, G5 . . . ). For example, the first, third, fifth, and other odd numbered sub-pixels in the row of sub-pixels between gate lines G1 and G2 as well as the row of sub-pixels between gate lines G2 and G3 share the even-numbered gate line G2, as illustrated through the TFT region of each respective odd numbered sub-pixel (P) in that row of sub-pixels.

Meanwhile, a connection structure of sub-pixels (P) of the data lines (D1 to Dn) may be implemented in units of four columns. As shown in FIG. 2, columns of sub-pixels (P) are positioned between an odd-numbered data line and an even-numbered data line. Sub-pixels (P) in a particular column may connect to an odd-numbered data line or an even-numbered data line in alternating order. Accordingly, a particular sub-pixel (P) in a column of sub-pixels (P) may connect to a different data line from the sub-pixel (P) directly above and directly below the particular sub-pixel (P) in the column of sub-pixels (P).

To illustrate, for sub-pixels (P) of the odd numbered (4k−3)-th column (where k is a natural number), odd-numbered sub-pixels (P) of the (4k−3)-th column are connected to an even-numbered data line (e.g., D2, D6 . . . ) and even-numbered sub-pixels (P) in the (4k−3)-th column are connected to an odd-numbered data line (e.g., D1, D5 . . . ). For example, for the first column of sub-pixels (P) shown in FIG. 2 positioned between data lines D1 and D2, the odd-numbered sub-pixels (P) in this first column of sub-pixels are connected to even-numbered data line D2. Even-numbered sub-pixels (P) in this first column of sub-pixels (P) are connected to odd-numbered data line D1. In this way, sub-pixels (P) of the first column sequentially alternate between connecting to data line D1 and data line D2.

In the case of sub-pixels (P) of the odd numbered (4k−1)-th column, sub-pixels (P) in the (4k−1)-th column sequentially alternate between connecting to an odd-numbered data line (e.g., D3, D7 . . . ) and to even-numbered data line (e.g., D4, D8 . . . ).

In the case of sub-pixels (P) of the even numbered (4k−2)-th column, sub-pixels (P) in the (4k−2)-th column sequentially alternate between connecting to an odd-numbered data line (e.g., D3, D7 . . . ) and to an even-numbered data line (e.g., D4, D8 . . . ).

In the case of sub-pixels (P) of the even numbered 4k-th column, sub-pixels (P) of the 4k-th column sequentially alternate between connecting to an even-numbered data line (D4, D8, . . . ) and to odd-numbered data lines (D5, D9 (not pictured) . . . ).

As shown in FIG. 2, a particular column connection structure repeats every four columns of sub-pixels (P).

The gate driver 4 sequentially generates scan pulses upon receiving a gate control signal (GCS) from the timing controller 8, for example, in response to a gate start pulse (GSP), a gate shift clock (GSC), a gate output enable (GOE) signal, or the like.

The gate driver 4 may divide a frame interval into multiple subframe intervals. As one example, the gate driver 4 divides a frame interval into a first subframe interval and a second subframe interval, and drives gate voltages (e.g. provides scan pulses) according to the first and second subframe intervals. That is, the gate driver 4 sequentially provides scan pulses to even-numbered gate lines (G2, G4, G6 . . . ) during the first subframe interval (See, e.g., FIG. 4). Subsequently, the gate driver 4 sequentially provides scan pulses to odd-numbered gate lines (G1, G3, G5 . . . ) to the gate driver 4 during the second subframe interval (See, e.g., FIG. 6).

The data driver 6 converts image data (e.g., RGB data) received from the timing controller 8 into a data voltage upon receiving a data control signal (DCS) from the timing controller 8. For example, the data driver 6 converts image data in response to a source start pulse (SSP), a source shift clock (SSC), a source output enable (SOE) signal, or the like. Upon receiving a polarity control signal from the timing controller 8, the data driver 6 may select a positive (+) or negative (−) gamma voltage having a predetermined level according to a gray scale value of RGB data, and generates a corresponding data voltage.

The data driver 6 transmits data voltages having different polarities to neighbor data lines (D1 to Dm) during one frame interval. In doing so, the data driver 6 may transmit a data voltage for sub-pixels (P) of odd-numbered columns to a plurality of data lines (D1 to Dm) during the first subframe interval. Subsequently, the data driver 6 may transmit a data voltage for sub-pixels (P) of even-numbered columns to a plurality of data lines (D1 to Dm) during the second subframe interval.

The timing controller 8 arranges RGB data received from an external part in response to driving of the liquid crystal panel 2, and provides the arranged RGB data to the data driver 6 for each of the first and second subframes. In addition, the timing controller 8 generates a gate control signal (GCS) and a data control signal (DCS) using at least one of external input synchronization signals (e.g., a dot clock (DCLK) signal, a data enable (DE) signal, a horizontal synchronization (Hsync) signal, and a vertical synchronization (Vsync) signal). The timing controller 8 provides the generated GCS and DCS signals to each of the gate and data drivers 4 and 6, thus allowing the timing controller 8 to control the gate and data drivers 4 and 6 using the GCS and DCS signals.

Figure 3:
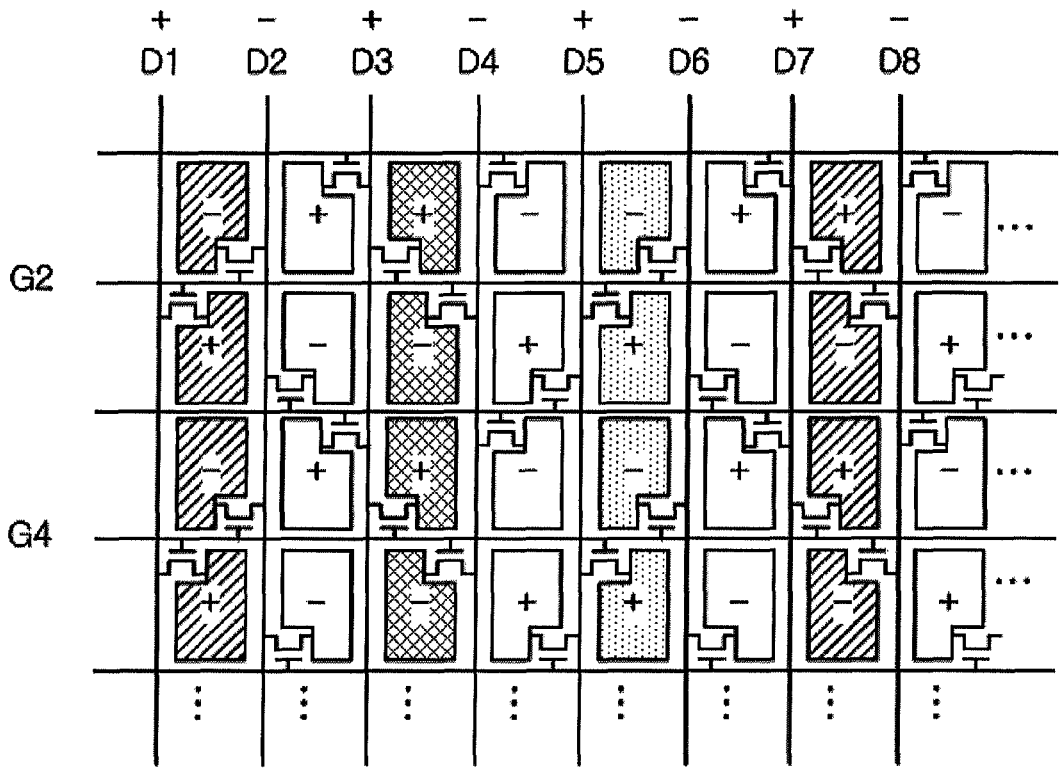
FIG. 3 is a schematic diagram illustrating sub-pixels for receiving a data voltage during a first subframe interval.
Figure 4:
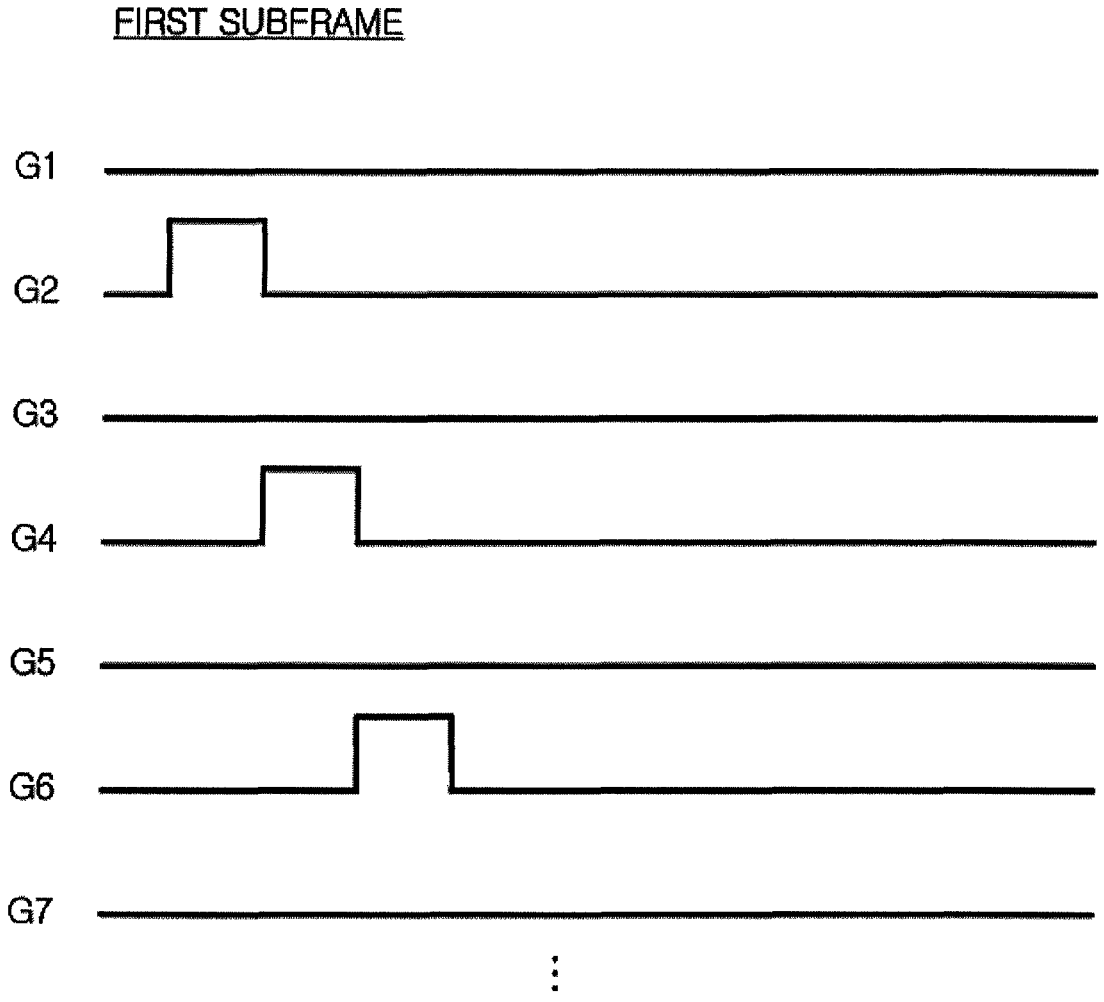
FIG. 4 is a waveform diagram illustrating scan pulses generated during a first subframe interval.
Figure 5:
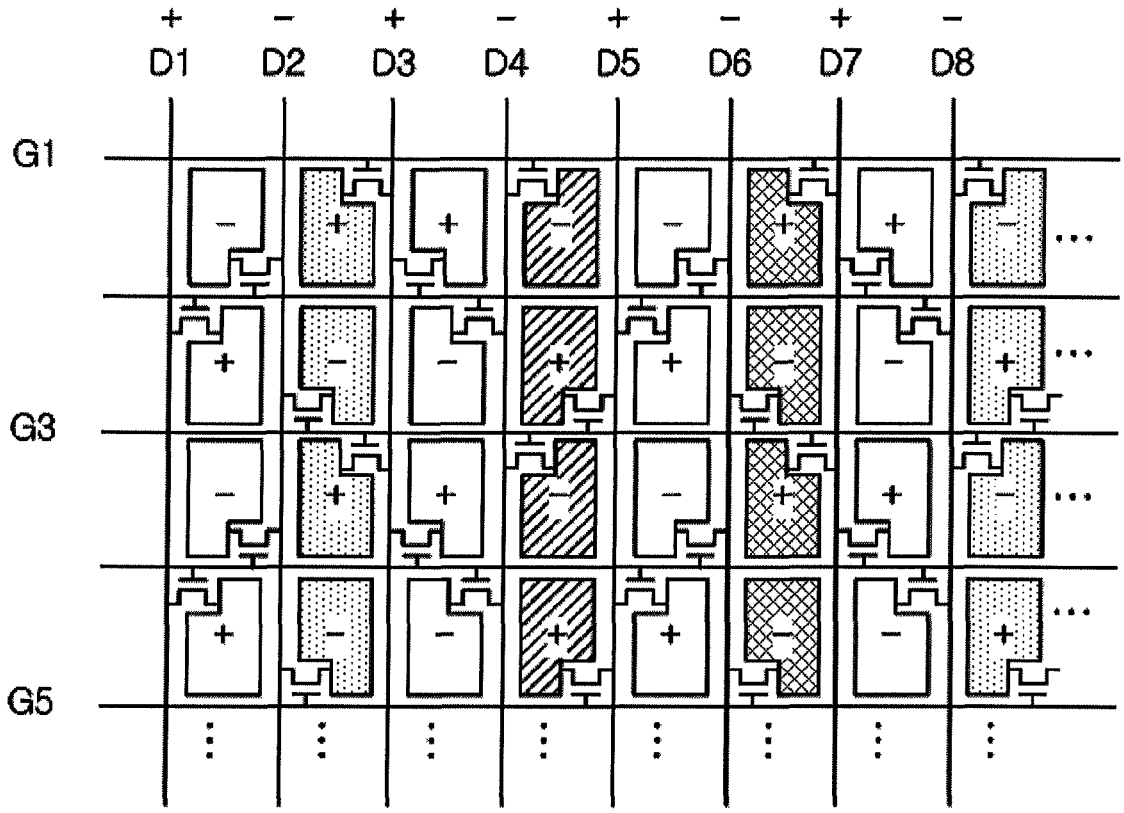
FIG. 5 is a schematic diagram illustrating sub-pixels for receiving a data voltage during a second subframe interval.
Figure 6:
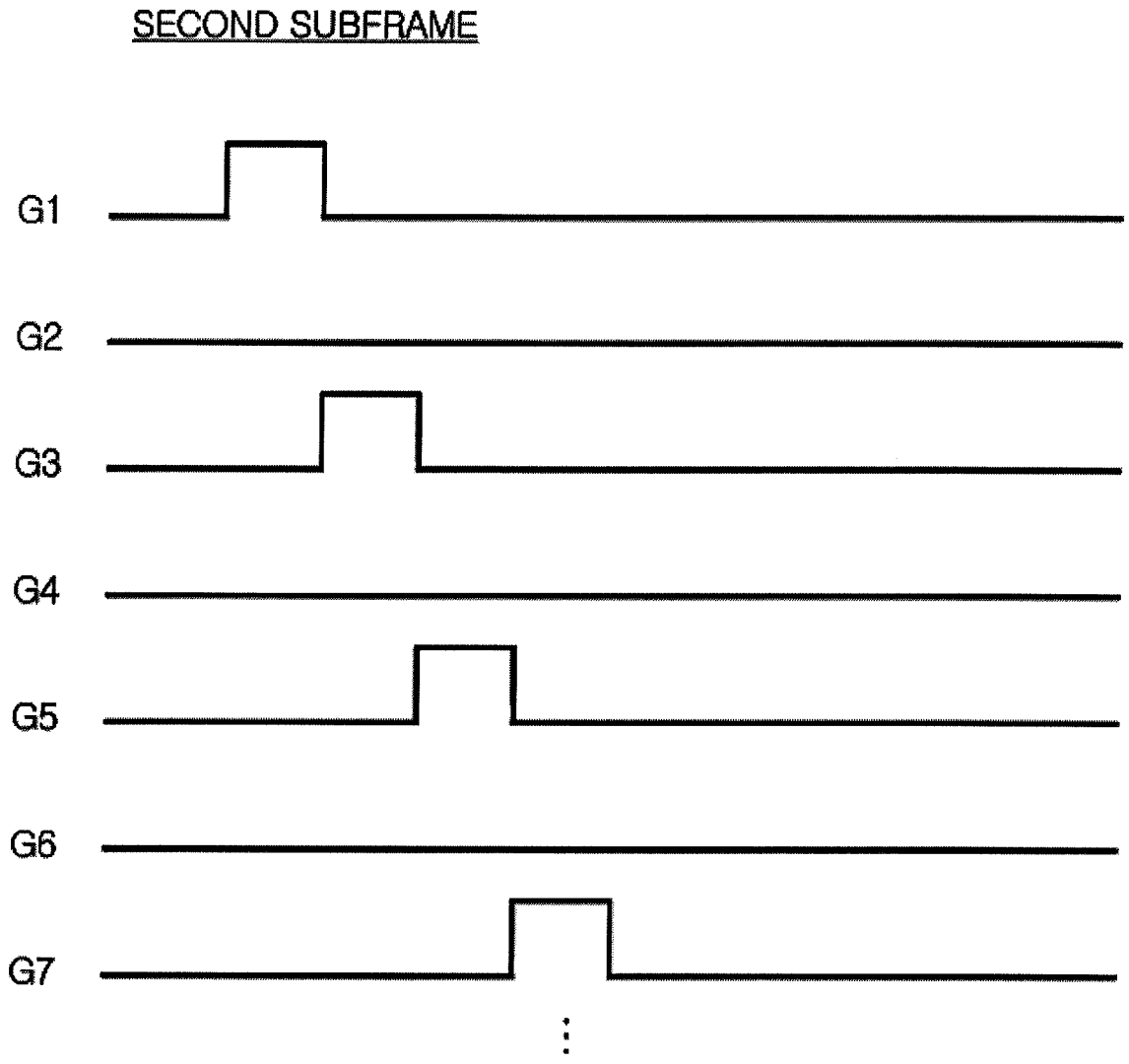
FIG. 6 is a waveform diagram illustrating scan pulses generated during a second subframe interval.

FIG. 3 is a schematic diagram illustrating sub-pixels (P) for receiving a data voltage during a first subframe interval. FIG. 4 is a waveform diagram illustrating scan pulses generated during a first subframe interval. FIG. 5 is a schematic diagram illustrating sub-pixels (P) for receiving a data voltage during a second subframe interval. FIG. 6 is a waveform diagram illustrating scan pulses generated during a second subframe interval.

Referring to FIGS. 3 and 4, the gate driver 4 sequentially transmits scan pulses to even-numbered gate lines (G2, G4, G6 . . . ), e.g., in response to a gate control signal (GCS) from the timing controller 8 during the first subframe interval. The data driver 6 is synchronized with scan pulses, such that the data driver 6 provides a data voltage for odd-numbered columns of sub-pixels (P) to a plurality of data lines (D1 to Dm). As a result, sub-pixels (P) in the (4k−3)-th columns (e.g., in the first, fifth, ninth columns, etc.) are configured to sequentially and repeatedly receive a negative (−) data voltage and a positive (+) data voltage. In a similar manner, sub-pixels (P) in the (4k−1)-th columns (e.g., in the third, seventh, eleventh columns, etc.) are configured to sequentially and repeatedly receive a positive (+) data voltage and a negative (−) data voltage. And as seen in FIG. 3, during the first subframe interval, sub-pixels (P) of odd-numbered columns (shaded in FIG. 3) are active while sub-pixels (P) of even-numbered columns (not-shaded in FIG. 3) are inactive.

Referring to FIGS. 5 and 6, the gate driver 4 sequentially transmits scan pulses to odd-numbered gate lines (G1, G3, G5 . . . ), e.g., in response to a gate control signal (GCS) from the timing controller 8 during the second subframe interval. The data driver 6 is synchronized with scan pulses, such that the data driver 6 provides a data voltage for even-numbered columns of sub-pixels (P) to a plurality of data lines (D1 to Dm). As a result, sub-pixels (P) of the (4k−2)-th columns (e.g., in the second, sixth, tenth columns, etc.) are configured to sequentially and repeatedly receive a positive (+) data voltage and a negative (−) data voltage. In a similar manner, sub-pixels (P) of the (4k)-th column (e.g., the fourth, eighth, twelfth columns, etc.) are configured to sequentially and repeatedly receive a negative (−) data voltage and a positive (+) data voltage.

As described above, the embodiment of the present invention can reduce power consumption of the gate and data drivers 4 and 6 using the interlace drive scheme, and can drive the data driver 6 using the column inversion scheme, resulting in reduction of power consumption of the data driver 6. Column inversion of the data driver 6 is converted into horizontal 2-dot inversion through Z-inversion driving, resulting in reduction of flicker and crosstalk. In addition, an unnecessary margin can be minimized in a thin film transistor (TFT) region of sub-pixels using a gate sharing structure, resulting in an increase in aperture ratio.

In accordance with the above embodiment, after the gate driver 4 provides scan pulses to even-numbered gate lines (G2, G4, G6 . . . ), the gate driver 4 provides scan pulses to odd-numbered gate lines (G1, G3, G5 . . . ). However, the above-mentioned order of supplying such scan pulses to the even-numbered gate lines and the odd-numbered gate lines is disclosed only for illustrative purposes, and the supply order is not limited thereto and may also be changed according to any number of orderings. For instance, the gate driver 4 may provide scan pulses to the odd-numbered gate lines (G1, G3, G5 . . . ) during a first subframe interval and, subsequently, provide scan pulses to even-numbered gate lines (G2, G4, G6 . . . ) during a second subframe interval. In this case, the data driver 6 is synchronized with the scan pulses such that the data driver 6 provides a data voltage for even-numbered columns of sub-pixels (P) to a plurality of data lines (D1 to Dm) during the first subframe interval. Then, the data driver 6 provides a data voltage for odd-numbered columns of sub-pixels (P) to the data lines (D1 to Dm) during the second subframe interval.

Figure 7:
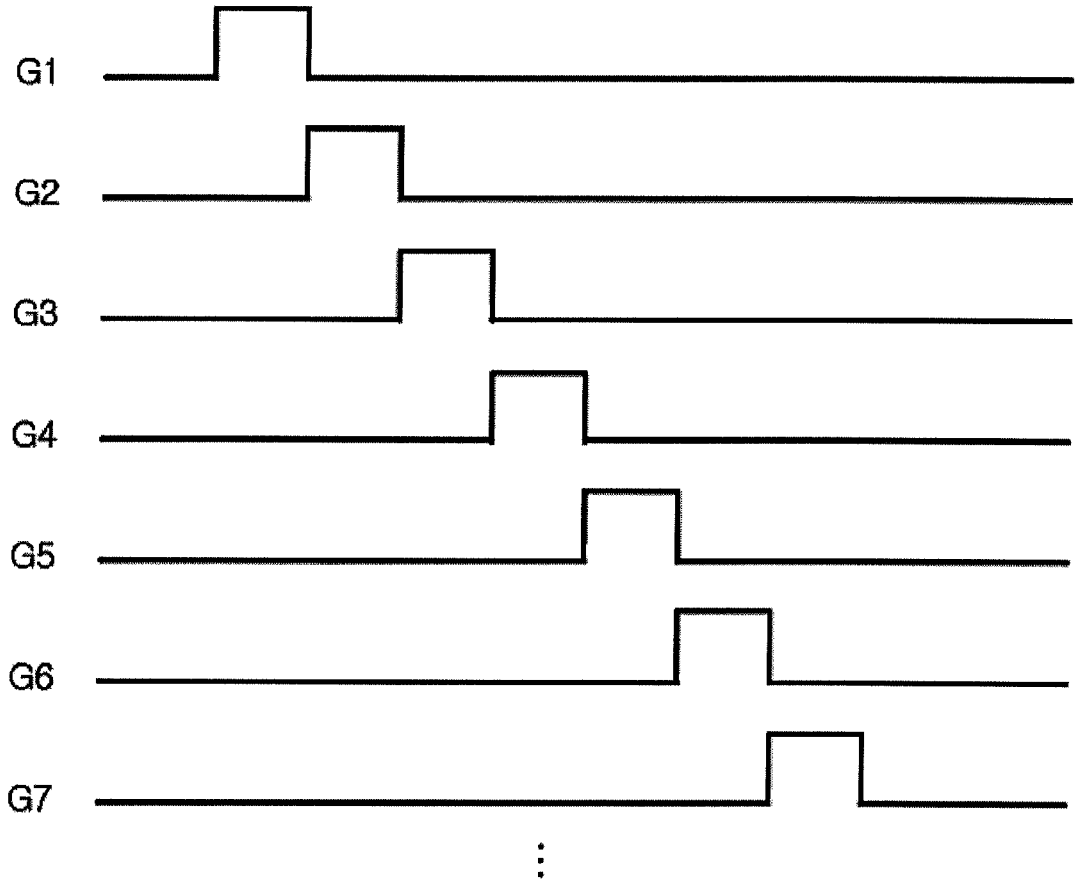
FIG. 7 is a waveform diagram illustrating scan pulses according to another embodiment of the present invention.

In another embodiment as shown in FIG. 7, the gate driver 4 may sequentially provide scan pulses to the gate lines (G1 to Gn). In this case, the data driver 6 is synchronized with the sequential scan pulses such that the data driver 6 provides a data voltage for even-numbered sub-pixels (P) to a plurality of data lines (D1 to Dm) and provides a data voltage for odd-numbered sub-pixels (P) to the data lines (D1 to Dm). In more detail, the data driver 6 is synchronized with scan pulses applied to odd-numbered gate lines (G1, G3, G5 . . . ), such that it provides a data voltage for even-column sub-pixels (P) to the data lines (D1 to Dm). The data driver 6 is synchronized with scan pulses applied to even-numbered gate lines (G2, G4, G6 . . . ), such that it provides a data voltage for odd-column sub-pixels (P) to the data lines (D1 to Dm).

As is apparent from the above description, the liquid crystal display (LCD) device and a method for driving the same can reduce power consumption of gate and data drivers using an interlace drive scheme, and can drive the data driver using a column inversion scheme, resulting in reduction of power consumption of the data driver.

Column inversion of the data driver is converted into horizontal 2-dot inversion through Z-inversion driving, resulting in reduction of flicker and crosstalk.

In addition, an unnecessary margin can be minimized in a thin film transistor (TFT) region of sub-pixels using a gate sharing structure, resulting in an increase in aperture ratio.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display (LCD) device comprising:

a liquid crystal panel comprising a matrix of sub-pixels defined by intersecting of a plurality of data lines and a plurality of gate lines, where the matrix of sub-pixels comprises:

a first row of sub-pixels positioned between a first gate line and a second gate line of the plurality of gate lines;

a second row of sub-pixels positioned between the second gate line and a third gate line of the plurality of gate lines;

a first column of sub-pixels positioned between a first data line and a second data line of the plurality of data lines; and a second column of sub-pixels positioned between the second data line and a third data line of the plurality of data lines;

wherein odd-numbered sub-pixels of the first column and even-numbered sub-pixels of the second column are connected in common to the second data line;

even-numbered sub-pixels of the first column are connected to the first data line; and odd-numbered sub-pixels of the second column are connected to the third data line; and the first column of sub-pixels are connected to even-numbered gate lines and the second column of sub-pixels are connected to odd-numbered gate lines;

a data driver configured to provide data voltages having different polarities between neighboring data lines such that the matrix of sub-pixels is driven according to a dot inversion scheme; and a gate driver configured to send a scan pulse to the even-numbered gate lines during a first subframe interval and send a scan pulse to the odd-numbered gate lines during a second subframe interval, wherein the scan pulses of the even numbered gate lines are not superposed and the scan pulses of the odd-numbered gate lines are not superposed;

wherein all of the sub-pixels in the first column are active and all of the sub-pixels in the second column are inactive during the first subframe interval, and all of the sub-pixels in the first column are inactive and all of the sub-pixels in the second column are active during the second subframe interval; and wherein the first data line is left-most data line, and the first, second and third data lines are arranged in said order.

2. The LCD device of claim 1, where pixels of the first row connected to the second gate line are vertically adjacent to pixels of the second row connected to the second gate line.

3. The LCD device of claim 1, where even-numbered sub-pixels of the first row are connected to the first gate line and odd-numbered sub-pixels of the first row are connected to the second gate line.

4. The LCD device of claim 1, where even-numbered sub-pixels of the second row are connected to the third gate line and odd-numbered sub-pixels of the second row are connected to the second gate line.

5. The LCD device of claim 1, where the dot inversion scheme is a horizontal 2-dot inversion scheme.

6. A liquid crystal display (LCD) device comprising:

a liquid crystal panel comprising a matrix of sub-pixels defined by intersecting of a plurality of data lines and a plurality of gate lines, where the matrix of sub-pixels comprises:

a first column of sub-pixels positioned between a first data line and a second data line of the plurality of data lines, and a second column of sub-pixels positioned between the second data line and a third data line of the plurality of data lines, wherein odd-numbered sub-pixels of the first column and even-numbered sub-pixels of the second column are connected in common to the second data line, even-numbered sub-pixels of the first column are connected to the first data line, odd-numbered sub-pixels of the second column are connected to the third data line, and the first column of sub-pixels are connected to even-numbered gate lines and the second column of sub-pixels are connected to odd-numbered gate lines;

a data driver configured to:

transmit data voltages having first polarity to the first and third data lines during a first frame, and transmit data voltages having a second polarity to the second data line during the first frame; and a gate driver configured to send a scan pulse to even-numbered gate lines during a first subframe interval and send a scan pulse to odd-numbered gate lines during a second subframe interval, wherein the scan pulses of the even-numbered gate lines are not superposed and the scan pulses of the odd-numbered gate lines are not superposed;

all of the sub-pixels in the first column are active and all of the sub-pixels in the second column are inactive during the first subframe interval, and all of the sub-pixels in the first columns are inactive and all of the sub-pixels in the second column are active during the second subframe interval;

the first data line is left-most data line; and the first, second and third data lines are arranged in said order.

7. The LCD device of claim 6, where the first and second column of sub-pixels are adjacent to one another.

8. The LCD device of claim 6, where the matrix of sub-pixels further comprises:

a third column of sub-pixels positioned between the third data line and a fourth data line of the plurality of data lines, and a fourth column of sub-pixels positioned between the fourth data line and a fifth data line of the plurality of data lines, wherein even-numbered sub-pixels of the third column and odd-numbered sub-pixels of the fourth column are connected to the fourth data line, odd-numbered sub-pixels of the third column are connected to the third data line, and even-numbered sub-pixels of the fourth column are connected to the fifth data line.

9. The LCD device of claim 8, where the third and fourth columns of sub-pixels are adjacent to one another.

10. The LCD device of claim 8, where the data driver is configured to send data voltages of the first polarity to the first, third, and fifth data lines and send data voltages of the second polarity different from the first polarity to the second and fourth data lines.

11. The LCD device of claim 8, further comprising:

a data driver configured to:

transmit data voltages to odd-numbered data lines during a first subframe interval; and transmit data voltages to even-numbered data lines during a second subframe interval.

12. The LCD Device of claim 11, where the data driver is further configured to transmit data voltages having different polarity to adjacent data lines.

13. A liquid crystal display (LCD) device comprising:

a liquid crystal panel comprising a matrix of sub-pixels defined by the intersecting of a plurality of data lines and a plurality of gate lines, where the matrix of sub-pixels comprises:

multiple rows of sub-pixels, where each row of sub-pixels is positioned between an even-numbered gate line and an odd-numbered gate line, and multiple columns of sub-pixels, where each column of sub-pixels is positioned between an even-numbered data line and an odd-numbered data line, wherein a pair of consecutive rows of sub-pixels, every other sub-pixel of the pair of consecutive rows is connected to a same gate line; and wherein first, second, third, and fourth columns of sub-pixels: even-numbered sub-pixels of the first column are connected to a first data line; odd-numbered sub-pixels of the first column and even-numbered sub-pixels of the second column are connected to a second data line;

odd-numbered sub-pixels of the second column and odd-numbered sub-pixels of the third column are connected to a third data line;

even-numbered sub-pixels of the third column and odd-numbered sub-pixels of the fourth column are connected to a fourth data line; and even-numbered sub-pixels of the fourth column are connected to a fifth data line;

sub-pixels in odd- numbered columns are connected to even-numbered gate lines and sub-pixels in even-numbered columns are connected to odd-numbered gate lines; and a gate driver configured to send scan pulses to the even-numbered gate lines during a first subframe interval and send scan pulses to the odd-numbered gate lines during a second subframe interval, wherein the scan pulses of the even-numbered gate lines are not superposed in time and the scan pulses of the odd-numbered gate lines are not superposed in time;

all of the sub-pixels in odd-numbered columns are active and all of the sub-pixels in even-numbered columns are inactive during the first subframe interval, and all of the sub-pixels in the odd-numbered columns are inactive and all of the sub-pixels in the even-numbered columns are active during the second subframe interval;

the first data line is left-most data line; and the first, second, third, fourth and fifth data lines are arranged in said order.

14. A liquid crystal display (LCD) device comprising:

a liquid crystal panel comprising a matrix of sub-pixels defined by intersecting of a plurality of data lines and a plurality of gate lines, where the matrix of sub-pixels comprises:

a first row of sub-pixels positioned between a first gate line and a second gate line of the plurality of gate lines;

a second row of sub-pixels positioned between the second gate line and a third gate line of the plurality of gate lines;

a first column of sub-pixels positioned between a first data line and a second data line of the plurality of data lines; and a second column of sub-pixels positioned between the second data line and a third data line of the plurality of data lines, wherein odd-numbered sub-pixels of the first column and even-numbered sub-pixels of the second column are connected in common to the second data line, even-numbered sub-pixels of the first column are connected to the first data line, odd-numbered sub-pixels of the second column are connected to the third data line, odd-numbered sub-pixels of the first row and the second row are connected in common to the second gate line, even-numbered sub-pixels of the first row are connected to the first gate line, even-numbered sub-pixels of the second row are connected to the third gate line, the first data line is left-most data line, and the first, second and third data lines are arranged in said order, a data driver configured to provide data voltages having different polarities between neighboring data lines such that the matrix of sub-pixels is driven according to a dot inversion scheme; and a gate driver configured to send a scan pulse to even-numbered gate lines during a first sub-frame interval and send a scan pulse to odd-numbered gate lines during a second sub-frame interval.

15. The LCD device of claim 14, wherein the dot inversion scheme is a horizontal 2-dot inversion scheme.

16. The LCD device of claim 14, wherein the data driver transmits data voltages having first polarity to the first and third data lines, and transmits data voltages having a second polarity to the second data line during the first frame.

17. The LCD device of claim 14, wherein the matrix of sub-pixels further comprises:

a third column of sub-pixels positioned between the third data line and a fourth data line of the plurality of data lines; and a fourth column of sub-pixels positioned between the fourth data line and a fifth data line of the plurality of data lines; and where even-numbered sub-pixels of the third column and odd-numbered sub-pixels of the fourth column are connected to the fourth data line;

odd-numbered sub-pixels of the third column are connected to the third data line; and even-numbered sub-pixels of the fourth column are connected to the fifth data line.

* * * * *